US005408062A

United States Patent [19]

Agnatovech

[11] Patent Number: 5,408,062

[45] Date of Patent: Apr. 18, 1995

[54] ROTARY SWITCH

[75] Inventor: William J. Agnatovech, Franklin, Mass.

[73] Assignee: Augat, Inc., Mansfield, Mass.

[21] Appl. No.: 81,465

[22] Filed: Jun. 22, 1993

[51] Int. Cl.[6] ..... H01H 19/14

[52] U.S. Cl. ..... 200/564; 200/565; 200/570; 200/43.02; 200/DIG. 30; 200/DIG. 62

[58] Field of Search ..... 200/564, 565, 567, 570, 200/571, 43.02, 43.11, 43.08, 275; 70/DIG. 30, DIG. 62

[56] References Cited

U.S. PATENT DOCUMENTS

| | | | |
|---|---|---|---|
| 2,817,721 | 12/1957 | Edwards | 200/565 |
| 3,184,449 | 5/1965 | Oxley | 200/11 |
| 3,270,151 | 8/1966 | Godette | 200/43.08 |
| 3,941,954 | 3/1976 | Wintringham | 200/44 |
| 4,009,357 | 2/1977 | Naylor | 200/42 |
| 4,227,056 | 10/1980 | Johnston et al. | 200/44 |
| 4,378,515 | 3/1983 | Nakai et al. | 315/290 |
| 4,405,843 | 9/1983 | Wolniak, et al. | 200/44 |
| 4,427,852 | 1/1984 | Wolniak et al. | 200/44 |
| 4,527,024 | 7/1985 | Lai | 200/11 |
| 4,558,193 | 12/1985 | Test | 200/43.08 |
| 4,623,763 | 11/1986 | Krause | 200/11 K |
| 4,639,562 | 1/1987 | Fredrickson | 200/43.08 |
| 4,748,297 | 5/1988 | Sorenson et al. | 200/11 J |
| 4,803,314 | 2/1989 | Sorenson et al. | 200/11 J |
| 4,890,006 | 12/1989 | Huang | 307/112 |
| 4,975,549 | 12/1990 | Krubsack et al. | 200/11 |

*Primary Examiner*—Henry J. Recla
*Assistant Examiner*—David J. Walczak
*Attorney, Agent, or Firm*—Weingarten, Schurgin, Gagnebin & Hayes

[57] ABSTRACT

A rotary switch includes a keylock housing having a collar disposed therein and a rotor disposed in a switch case housing to provide an internal labyrinth geometry. The collar includes a plurality of spaced mechanical stops to provide multiple mechanical travel options determined by the orientation with which the collar is disposed in the housing. Thus the stop collar may be disposed in the keylock housing in a plurality of different orientations with each of the orientations providing a keylock mechanism disposed in the keylock housing with a corresponding mechanical travel. The internal labyrinth geometry provided by the rotor-switch case housing assembly increases the electrical path length through which an electric charge must travel. Thus, the rotor-switch case housing assembly provides the rotary switch with protection from electrostatic discharge.

17 Claims, 8 Drawing Sheets

ROTARY SWITCH

FIELD OF THE INVENTION

This invention relates to rotary switches more and particularly to anti-static rotary switches.

BACKGROUND OF THE INVENTION

As is known in the art, a rotary switch typically includes a contact mechanism in which a plated rolling contact is disposed in a rotor. An insulator is disposed between the rolling contact and a spring. The rotor and rolling contact are disposed in a switch housing having a mechanical stop cast therein to provide the rotor having a predetermined mechanical travel. The insulator prevents the spring from wearing away the contact plating. The switch contacts are typically disposed on one end of the switch housing and provide electrical contact between a pair of terminals in a system to which the switch is connected.

Such rotary switches may be used, for example, in computer systems, cash registers, security systems or in any other applications which may utilize a switch to engage and disengage an electrical contact between two terminals. In many applications such switches are used to alternately turn the systems on and off. Thus, in those applications, the rotary switch may be used to engage and disengage operating power from the systems.

As is also known in the art, electrostatic charges typically in the range of 6 kilovolts to 20 kilovolts or more can easily accumulate on a person working in a modern office environment particularly where extensive use is made of synthetic carpeting. Thus, one problem with rotary switches is that such electrostatic charges accumulate on the user of the system and discharge from the user to metal portions of the switch housing or to contact terminals connected to the system.

Such electrical discharge may provide an electric shock to the user and may also result in temporary or permanent damage to the rotary switch or to electrical components within the system to which the switch is connected. To prevent such electrostatic discharge (ESD) from being conducted between a user and the switch contacts, the distance between the charged surface and the switch contacts is often maximized. One problem with this approach however is the concomitant increase required in the length of the rotary switch to prevent the electrostatic discharge from occurring.

Furthermore, electrical arcs may occur due to disconnecting a circuit in which a current typically of about 1 ampere or more is flowing. Such arcs may soften or even melt a material from which the base is made or and plating of the switch contact. When the base material and plating is in such a melted state, the shape of the material may be changed due to the arc or due to mechanical components contacting the base while the base material is in a malleable state. The surface of the disc may thus be disrupted thereby preventing the intended rolling between the rolling contact and the rotor.

Rotary switches may also be provided as a so-called keylock rotary switch having a lock body and a lock cylinder. In the keylock rotary switch, the stop feature is generally die cast into the lock body and cylinder. Thus, keylock switches having unique mechanical travels require unique lock bodies.

SUMMARY OF THE INVENTION

In accordance with the present invention, a rotary switch includes a switch case having a sidewall. An inner surface of the sidewall, having a plurality of recess regions provided therein, defines a cavity region. A platform having a sleeve portion with a bore therethrough is disposed in the cavity region of the switch case and is coupled to the sidewall inner surface. A rotor including a rotor body and a rotor sleeve is disposed in the cavity region of the lock mechanism. The rotor body is disposed over the platform sleeve such that the platform sleeve is disposed in the recess of the rotor body and the rotor sleeve is disposed through the bore of the platform sleeve to form a labyrinth passage between first and second opposing ends of the switch case. A contact is disposed in a slot formed in a first end of the rotor body, a detent spring is disposed in a transverse bore formed through the rotor body and a pair of detents are disposed on opposite ends of the spring to engage particular ones of the recesses formed in the sidewall. With this particular arrangement an antistatic rotary switch is provided. The contacts may be provided having a U-shape with the legs of the contacts having a bulbed end portion which may engage a shoulder formed in the slot in which the contact is disposed to create a stable sub-assembly. Thus fewer components are required to provide the contact mechanism. The spring and detents which engage the recesses provided in the sidewall of the housing provide a positive detent mechanism. Furthermore, the contact shape of the present invention provides a positive wiping action in the contact area. Moreover, the labyrinth created by disposing the rotor in the switch case increases the path length an electric charge must travel through the switch. Thus a rotary switch less susceptible to electrostatic discharge is provided without a concomitant increase in the length of the switch. The switch may also be provided having a collar which may be disposed in a keylock housing for example. The collar includes a plurality of spaced mechanical stops to provide multiple mechanical travel options determined by the orientation with which the stop collars are disposed in the keylock housing, or alternatively the switch case. Thus the stop collar determines the mechanical travel of the switch assembly. In conventional systems the stop may be formed integrally with the lock mechanism. Thus, in the present invention, a standard lock may be used in switch assemblies having a collar disposed therein to provide a plurality of different mechanical travels from the same lock body.

BRIEF DESCRIPTION OF THE DRAWINGS

The foregoing features of this invention as well as the invention itself may be more fully understood from the following detailed description of the drawings in which.

DESCRIPTION OF THE PREFERRED EMBODIMENTS

Figure 1:
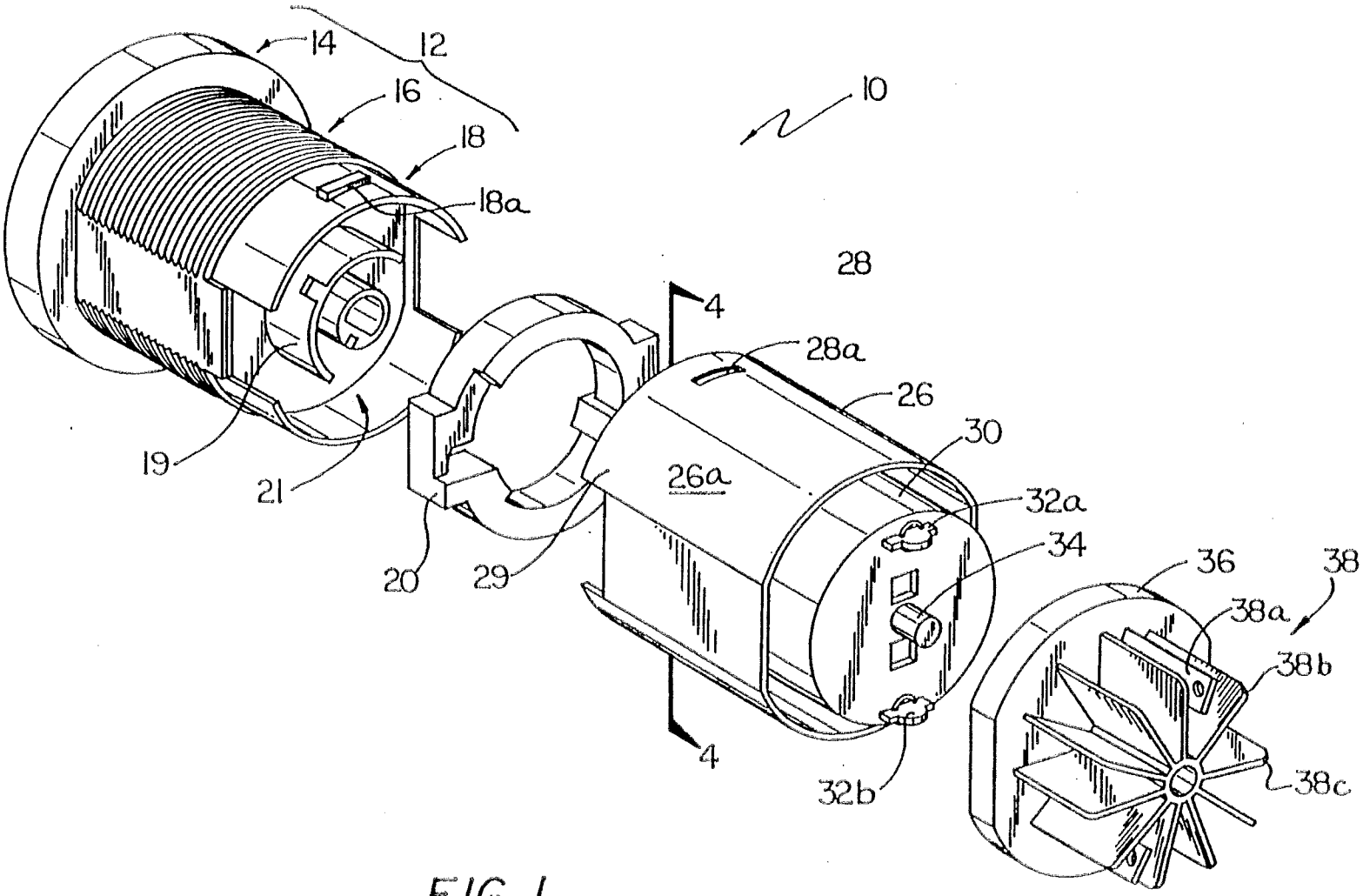
FIG. 1 is an exploded perspective view of an anti-static rotary switch.

Referring now to FIG. 1, an antistatic rotary switch 10 includes a keylock body 12 having a top portion 14, a threaded portion 16, and a bottom portion 18. Here the keylock body 12 is provided having a keylock assembly including a sleeve 19 disposed therein to thus provide the rotary switch 10 as a keylock rotary switch. Those of ordinary skill in the art however will recognize of course that the body 12 need not be provided as a keylock body, but rather any control apparatus such as a control knob (not shown) for example may also be used.

A pair of rectangular shaped bosses project from opposite sides of the bottom portion 18, a first boss 18*a* here being shown. A collar 20 having a plurality of raised and recessed portions is disposed about the sleeve 19 in a first recessed surface 21 of the lock body 12. The sleeve 19 rotates in response to the turning of a key (not shown) which is inserted into the keylock 12.

Figure 2:
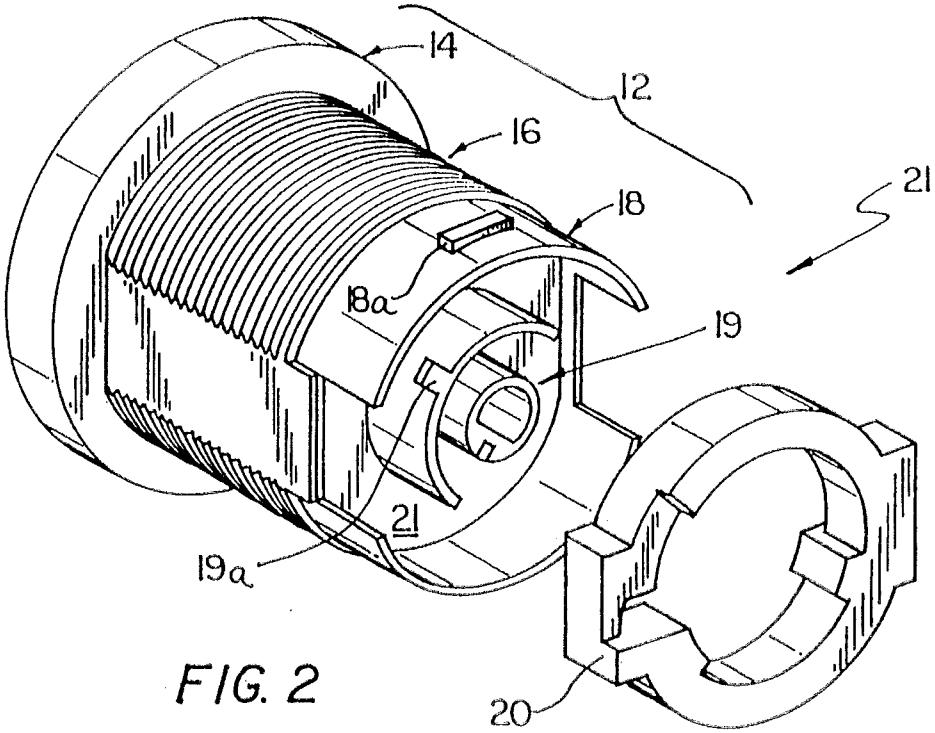
FIG. 2 is a perspective view of a keylock assembly.
Figure 2D:
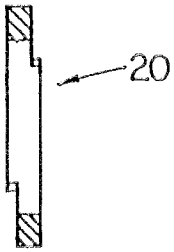
FIGS. 2A–2D are a series of views of the collar illustrated in FIG. 2.
Figure 2C:
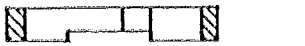
Figure 2B:
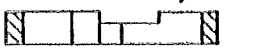
Figure 2A:
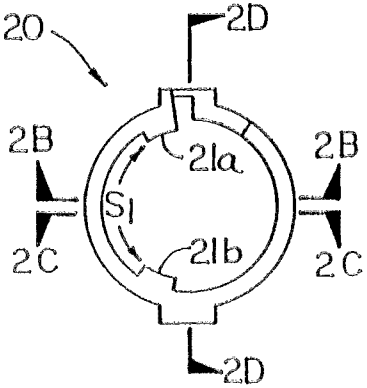

As may be more clearly seen in FIGS. 2–2C in which like elements are provided having like reference designations throughout the several views, the collar 20 includes spaced first and second raised portions 21*a*, 21*b*. As mentioned above, the collar 20 is disposed in the keylock assembly about the sleeve 19. A tab 19*a* is provided on a portion of the sleeve 19 to engage the raised portions of the collar 21*a*, 21*b*. Thus, the raised and recessed portions 21*a*, 21*b* of the collar 20 provide mechanical stops for the lock assembly including the sleeve 19. The spacing between the raised portions 21*a*, 21*b* therefore determines the mechanical travel of the keylock 12.

It should be noted that the collar 20 may be provided such that a plurality of spaced mechanical stops may provide multiple mechanical travel options determined by the orientation with which the collar 20 is here shown disposed in the keylock housing, but may alternatively be disposed in the switch case. That is, the collar 20 may be disposed in the lock assembly in a first orientation provide a first mechanical travel or alternatively the collar may be rotated to a second different orientation (e.g. 180 degrees from the first orientation) and disposed in the lock assembly to provide the keylock having a second different mechanical travel. Furthermore, a plurality of different collars 20 (not shown) each having a different spacing between raised portions thereof may be interchangeably disposed in the keylock 12. By providing the collar 20 having a different spacing between the raised portions 21*a* and 21*b*, the same keylock 12 may thus be provided having a plurality of different mechanical travels.

Referring again to FIG. 1, a substantially cylindrical switch case 26 has a pair of oppositely disposed slots 28*a*, 28*b* in a first end thereof, a first one of the slots 28*a* here being shown. The switch case 26 is disposed over the bottom portion 18 of the lock body 12 such that each boss 18*a*, 18*b* is disposed through a corresponding one of the slots 28 defined by a corresponding portion of the switch case 26 to thus secure the switch case 26 to the lock body 12.

An inner surface of the sidewalls 26*a* of the switch case 26 define a cavity region (not shown) in which a rotor 30 is disposed. The rotor 30 will be described further in conjunction with FIG. 3 below, suffice it here to say that a first end of the rotor 30 is operatively coupled to the sleeve 19 such that the rotor 30 is moveable by inserting a key (not shown) into the lock body 12 and turning the key. As mentioned above, the collar 20 controls the mechanical travel of the lock assembly 12.

A second end of the rotor 30 including a rotor guide pin 34 extends through the second end of the switch case 26. A pair of contacts 32*a*, 32*b* are disposed on a first surface of the second end of the rotor 30. A cover 36 having a plurality of switch-terminals 38*a*–38N disposed therein is fitted to the second end of the switch case 26 over the rotor guide pin 34 such that when the switch sleeve 19 is in a first position, first predetermined ones of the switch terminals 38 are disposed against at least one of the contacts 32 and when the switch sleeve 19 is in a second, different position, second predetermined ones of the switch terminals 38 are disposed against at least one of the contacts 32.

Figure 3A:
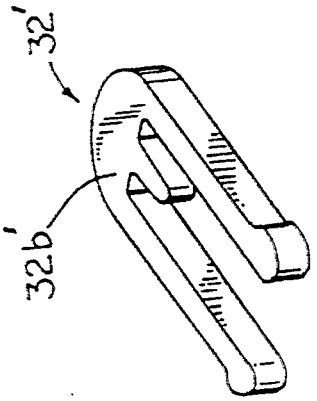
FIG. 3A is a perspective view of a contact which may be used in the rotor of FIG. 3.
Figure 3:
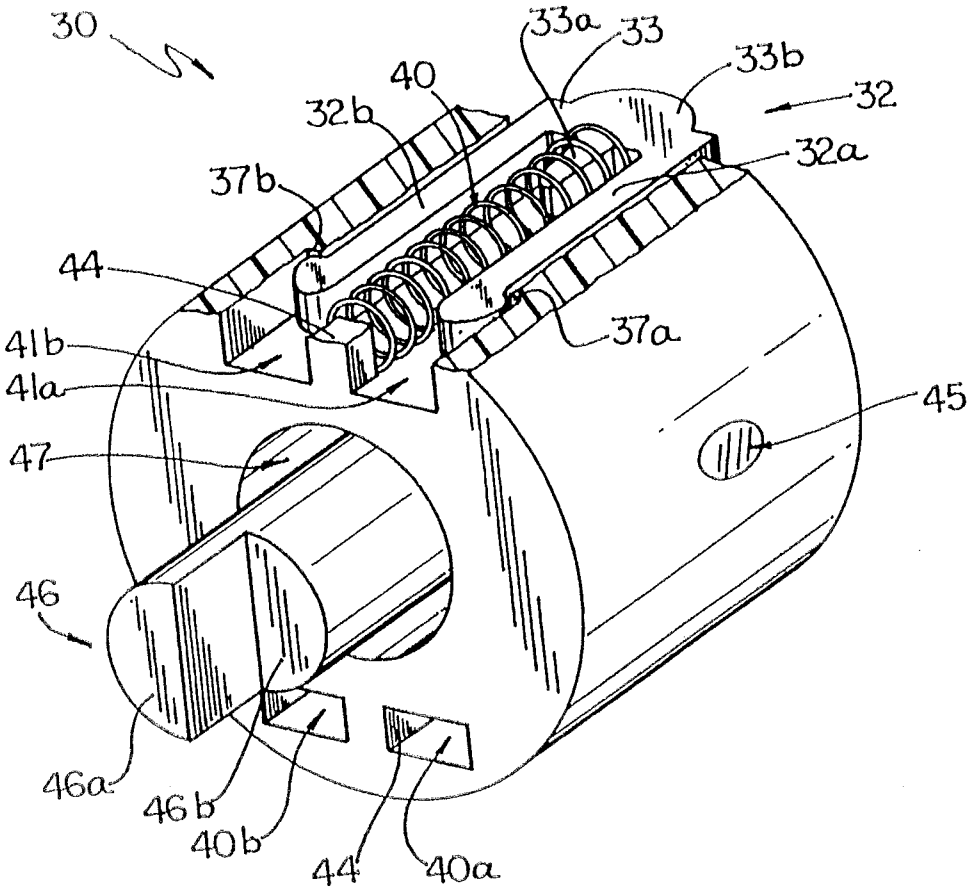
FIG. 3 is a perspective view of a rotor.

Referring now to FIG. 3 in which like elements of the rotor 30 of FIG. 1 are provided having like reference designations, the rotor 30 is shown having two pairs of slots 40*a*, 40*b* and 41*a*, 41*b* disposed through opposite sides thereof. A portion of the rotor 30 has here been removed to more clearly show a substantially U-shaped contact 32 disposed in the slots 41*a*, 41*b*. The contact 32 is provided having a pair of legs 32*a*, 32*b* each of the legs terminating at first bulbed end. A second end of the legs 32*a*, 32*b* terminates in first and second opposing ends of a cross bar 33 connected between the legs 32*a*, 32*b* of the contact 32. First and second opposing surfaces of the cross bar each include a raised portion 33*a*, 33*b*.

Referring now to FIG. 3A, a contact 32' includes a raised portion 32*b'* having a semicircular shape. It should be noted that the contacts 32, 32' may be provided having a plating disposed over the surface thereof. The plating may be provided from any suitable material including silver or gold. In those applications in which relatively high current is used, silver is preferred to reduce the probability of arcing.

A spring 40 is disposed between the first raised portion 33*a* of the contact 32 and a spring stop 44 formed in the rotor 30. The spring 40 urges the bulbed portions of the contact legs 32*a*, 32*b* against a corresponding one of a pair of shoulders 37*a*, 37*b* provided in the slots 41*a*, 41*b*. A like contact (not shown) is similarly disposed in the grooves 40*a*, 40*b*. The rotor 30 further includes a rotor shaft 46 disposed along the central longitudinal axis of a centrally located recess 47 provided in the body of the rotor 30. The rotor shaft 46 is provided having a first raised portion 46*a* and a second portion 46*b*. A transverse bore 45 is provided through the rotor body.

Figure 4:
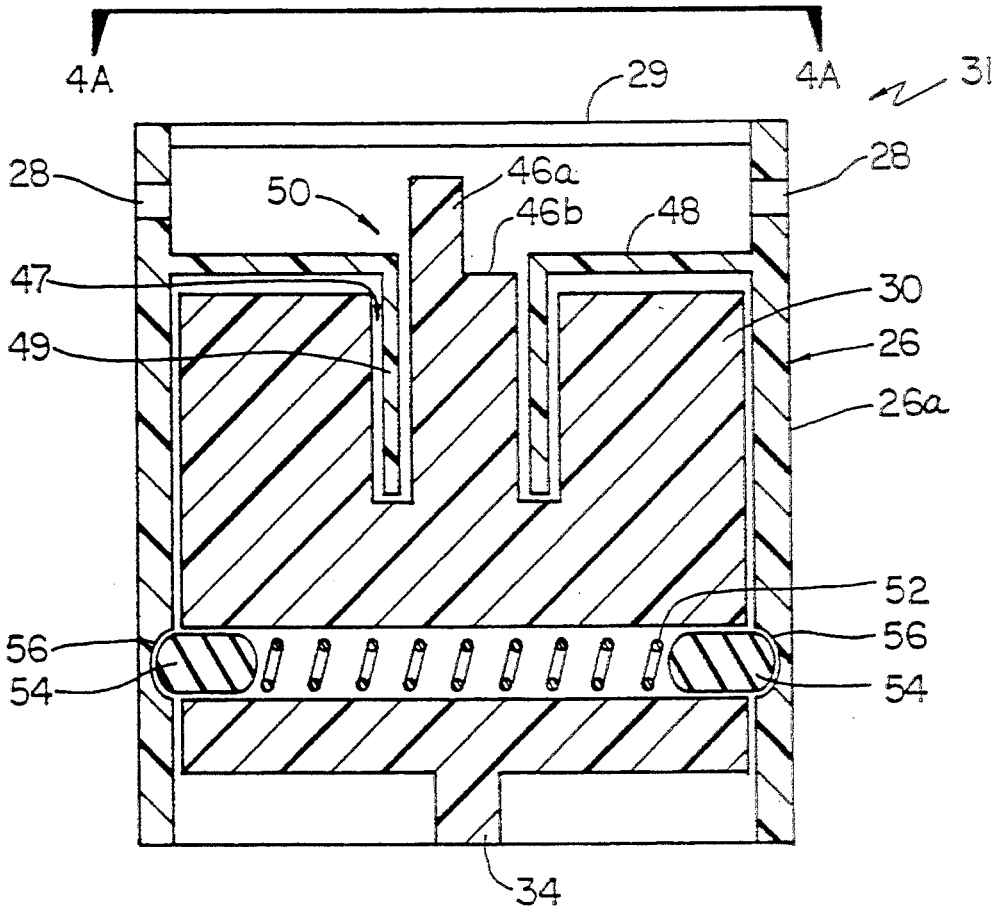
FIG. 4 is a cross-sectional view of a rotor disposed in a switch case to provide a rotor-switch assembly.
Figure 4A:
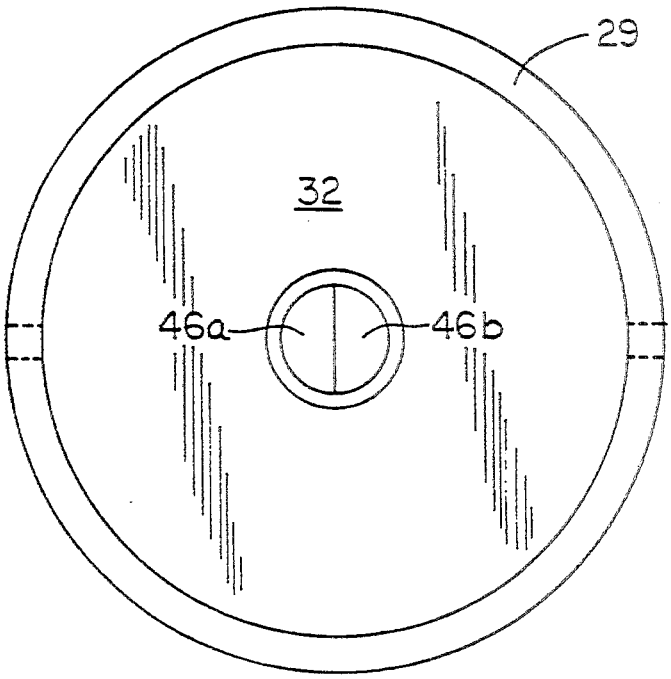
FIG. 4A is an end view of the rotor switch assembly of FIG. 4.

Referring now to FIGS. 4 and 4A, in which like elements of the rotor 30 switch case 26 are provided having like designations the rotor 30 is disposed in the switch case 26 as shown, to provide a switch-rotor assembly 31. The switch case 26 includes a platform 48 having a sleeve region 49 which defines a passageway 50.

The rotor 30 is disposed in the switch case 26 such that the switch case sleeve 49 is disposed in the recess 47 of the rotor 30 and the rotor shaft 46 is disposed through the passageway 50 to provide a labyrinth between the first and second opposing ends of the rotor-switch case assembly 31. A spring 52 is disposed in the rotor bore 45 and a pair of detent bullets 54 are disposed on opposite ends of the spring 50.

The inner surfaces of the sidewall regions of the switch case 26 are provided having a plurality of recesses 56 provided therein to accept the detent bullets 54. Thus when the rotor 30 turns, the detent bullets 54 engage predetermined ones of the recesses 56. When the detents 54 are engaged in one of the plurality of recesses 56, the spring 52 provides a force to maintain the detent position. When the detents 54 disengage and move out of the recesses 56 the spring 52 compresses to allow the rotor 30 to turn. By symmetrically disposing the bullet detents 54 about the rotor 30 the detents 54 provide an equal force between each side of the rotor 30 and the sidewall of the switch case 26. Thus by symmetrically disposing the detents about the rotor 30, the rotor 30 is prevented from being asymmetrically disposed within the switch case 26.

In an alternate embodiment, the detents 54 may be replaced by a contact having a shape similar to the shape of the contact 32 to thus provide the detent mechanism.

Figure 5:
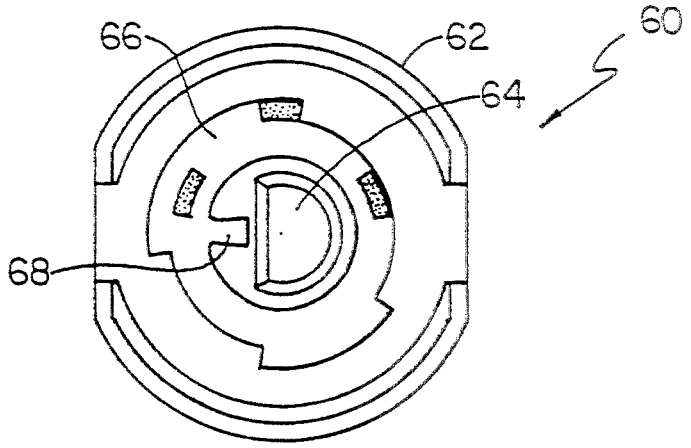
FIGS. 5–5B are a series of end views of a keylock having a torsion spring.
Figure 5A:
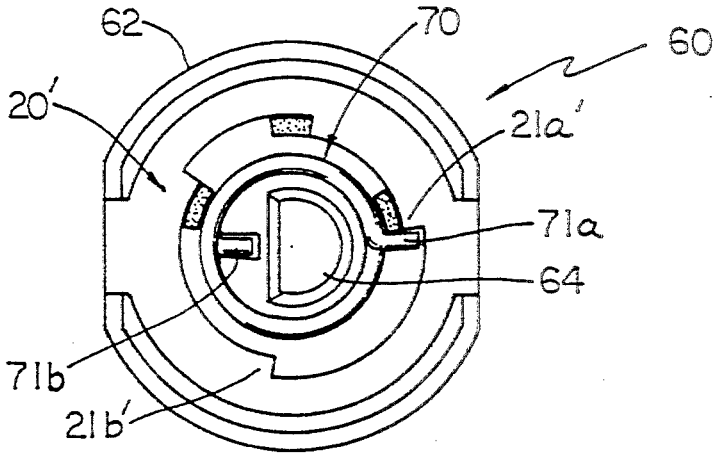
Figure 5B:
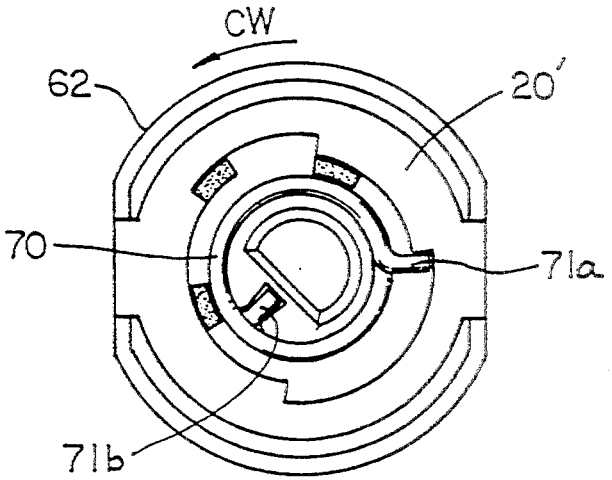

Referring now to FIGS. 5–5B in which like elements are provided having like reference designations throughout the several views, a keylock 60 includes a bottom portion 62 having a sleeve 64 rotatably disposed therein. The sleeve 64 is here provided having a D shaped cross-section in an alternative configuration of the sleeve 19 illustrated in FIGS. 1 and 2. Sleeve 64 rotates in response to the turning of the key (not shown) which may be inserted into a second opposite end (not shown) of the keylock body 60.

The bottom portion includes an irregularly shaped recessed portion 66 and a recess inlet 68. A collar 20' (FIG. 5A) having a plurality of raised and recessed portions is disposed about the sleeve 64 in the recessed surface 66 of the bottom portion 62. The collar 20' may be similar to the collar 20 described above in conjunction with FIGS. 2A through 2D. The collar 20' includes spaced first and second raised portions **21*a*', 21*b*'**.

A torsion spring 70 having extended portions **71*a*, 71*b* is disposed in the recess portions of the key bottom portion 62. In particular, the torsion spring 70 is disposed such that the extended region 71*b* is disposed in the recess inlet 68 of the bottom portion 62 and the extended region 71*a* of the torsion spring 70 contacts the raised portion 21*a*' of the mechanical collar 20'**.

Figure 6:
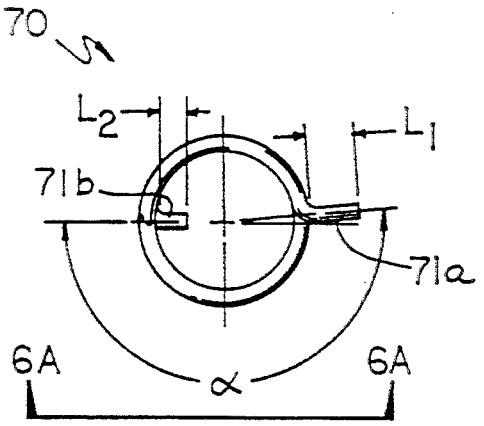
FIGS. 6–6E are a series of views of torsion springs which may be used in keylocks of the type described in conjunction with FIGS. 5–5B or 7–7B.
Figure 6A:
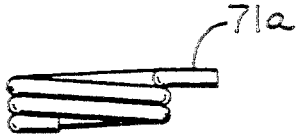
Figure 6B:
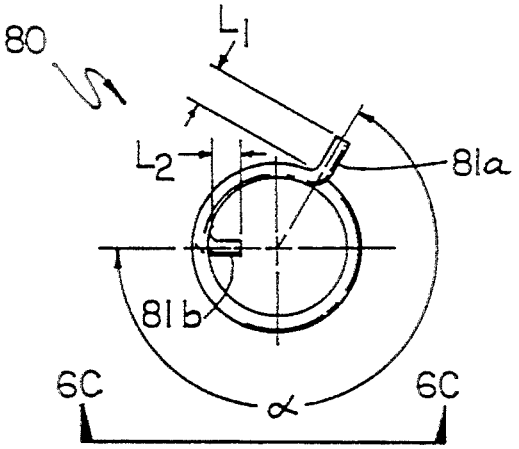
Figure 6C:
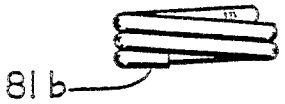

Referring briefly to FIGS. 6 and 6A, the torsion spring 70 is here shown having the extended region **71*a* having a length $L_1$ typically of about 0.090 inches while the extended region 71*b* is provided having a length $L_2$ typically of about 0.062 inches. The lengths $L_1$ and $L_2$ of the extended regions 71*a*, 71*b* may of course correspond to any length selected to cooperate with the dimensions of the bottom portion 62 (FIG. 5A) and collar 20' (FIG. 5A). The first and second extended regions 71*a*, 71*b*** are spaced by a distance $\alpha$ here corresponding to about 180 degrees.

As may be more clearly seen in FIGS. 6B–6E however, the first and second extended regions **71*a*, 71*b* may be space by more or less than 180 degrees. For example, in FIGS. 6B and 6C a torsion spring 80 is provided having first and second extended regions 81*a*, 81*b*** spaced by a distance $\alpha$ typically of about 140 degrees.

Figure 6D:
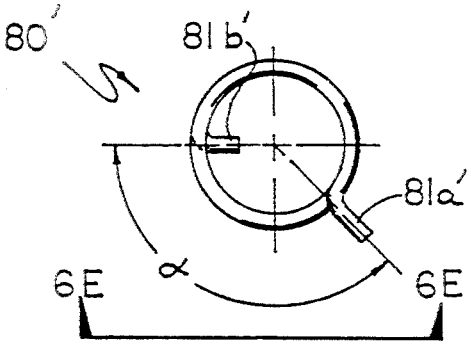
Figure 6E:
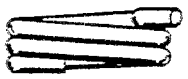

Similarly in FIGS. 6D and 6E a torsion spring 80' is provided having first and second extended regions **81*a*' and 81*b*' spaced by a distance $\alpha$ typically of about 240 degrees. Suffice it to say that spacing between the extended regions of the torsion spring may be selected to provided any desired turning distance or tension. It should be noted however that the collar 20' should be provided having raised and recessed portions spaced to cooperate with a selected one of the torsion springs 70, 80 or 80'**.

Referring again to FIGS. 5–5B, by disposing the torsion spring 70 in the bottom portion 62, the torsion spring 70 provides a momentary function to the keylock body 60. That is, in response to turning the key and consequently the sleeve 64, the torsion spring 70 returns the sleeve 64 and consequently the key to its initial position upon release of the key. Those of ordinary skill in the art will recognize that the key here acts as a turning mechanism and that other turning mechanisms such as knobs or the like may also be used.

The collar 20' and the torsion spring 70 here shown, provide the lock assembly having a zero to forty-five degree rotation span. Thus, in response to turning the key in a clockwise direction as shown in FIG. 5B, the sleeve 64 and extended portion **71*b* rotate a distance of approximately 45 degrees. However, when the key is released, the torsion spring 71** returns the keylock to its initial position.

The torsion spring 70 is here provided as a left hand wound helix. The torsion spring may be provided from a wire having a diameter typically of about 0.027 inches and having typically of about three to five wrapped coils with a mean coil diameter typically of about 0.290 inches. Those of ordinary skill in the art will recognize of course that the number of coils which provide the torsion spring, the material from which the wire is made and the diameter and shape of the wire may all be selected according to a variety of factors including but not limited to the desired spring tension, the size and shape of the corresponding collar and the size and shape of the recess in which the torsion spring is to be disposed.

Figure 7:
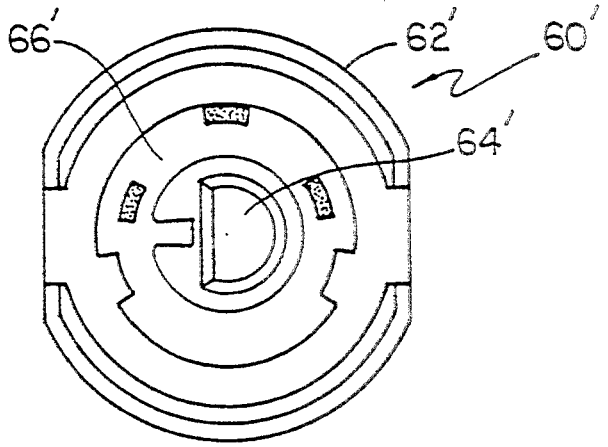
FIGS. 7–7B are a series of end views of a keylock having a torsion spring.
Figure 7A:
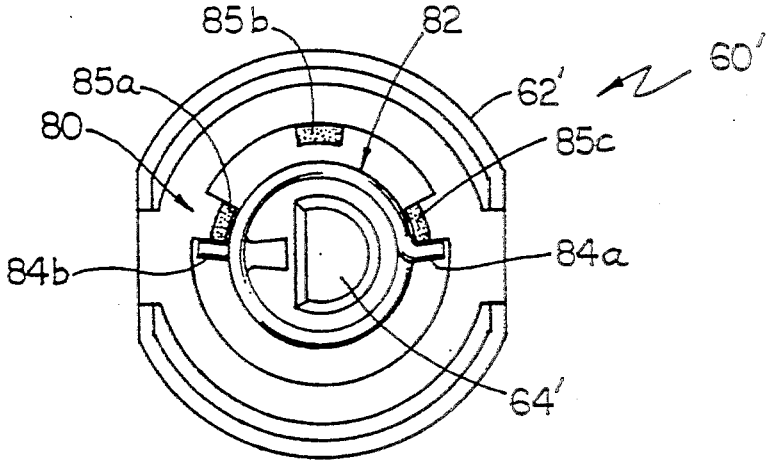
Figure 7B:
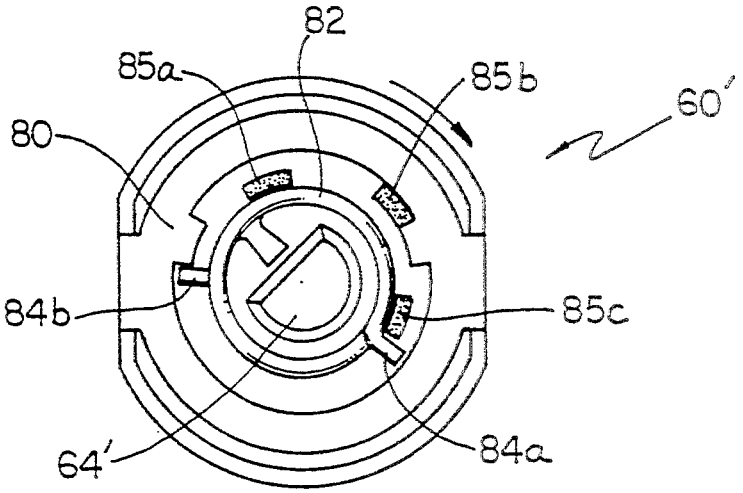

Referring now to FIGS. 7–7B, a torsion spring 80 used in conjunction with a mechanical collar 82, provides a −45 to +45 degree momentary function. Regardless of whether the mechanical collar 20' (FIG. 5) or the mechanical collar 82 are disposed in the bottom portion 62, the mechanical collar provides a fixed stop for the corresponding extended region **71*a*, 81*a* of the respective one of the springs 70, 80 while the sleeve 64'** provides the drive mechanism.

Thus, by selecting a particular combination of mechanical collars and torsion springs, the keylock body 60 may be provided having a momentary function in which in response to either a clockwise or counterclockwise key rotation, before the torsion spring returns the keylock to its initial position.

Figure 8:
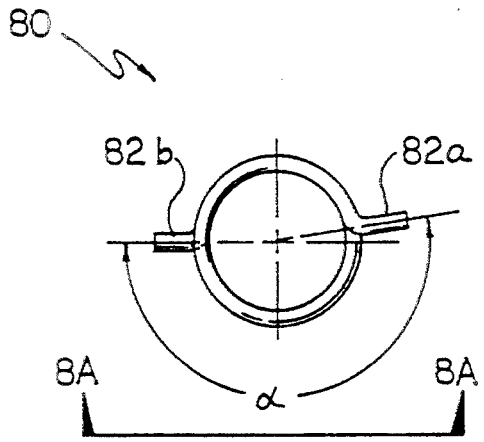
FIGS. 8–8C are a series of views of torsion springs which may be used in keylocks of the type described in conjunction with FIGS. 5–5B or 7–7B.
Figure 8A:
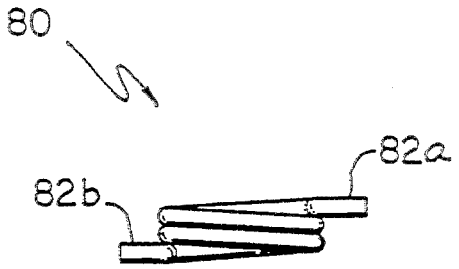
Figure 8B:
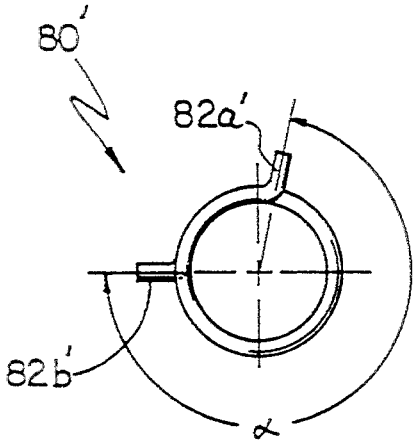
Figure 8C:
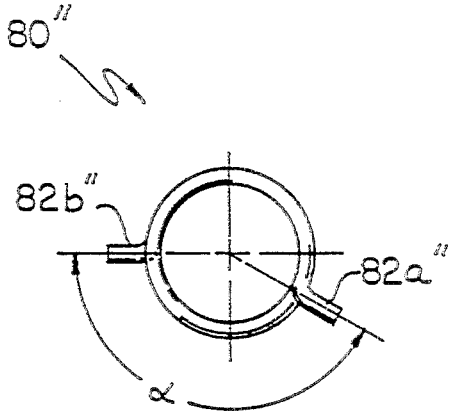

Referring now to FIGS. 8–8C a plurality of torsion springs 80–80' are shown. Each of the torsion springs 80–80' may be disposed in a keylock assembly having a collar similar to the collar 82 described above in conjunction with FIGS. 7–7B. Each of the torsion springs 80–80'' are provided having extended regions **82*a*, 82*b* spaced by different distances. Each of the plurality of springs 80–80″ when disposed in an appropriately selected collar provides a different range of motion to the sleeve 64′**.

Having described preferred embodiments of the invention, it will now become apparent to one of skill in the art that other embodiments incorporating the concepts may be used. It is felt, therefore, that these embodiments should not be limited to disclosed embodiments but rather should be limited only by the spirit and scope of the appended claims.

What is claimed is:

1. A switch rotor comprising:

a switch case having first and second opposing ends and having an inner sidewall surface which defines a cavity region, said inner sidewall surface having provided therein a plurality of recess regions; a platform having a sleeve portion with a bore therethrough disposed in the cavity region of said switch case and coupled to the inner sidewall surface of said switch case;

a rotor disposed in the cavity region of said switch case, said rotor comprising:

a rotor body having first and second opposing end surfaces, a recess provided in a central portion of the first end surface of said rotor body, a plurality of slots provided in the second end surface of said rotor body, and a transverse bore provided through opposing side surfaces of said rotor body;

a rotor sleeve disposed in the central recessed portion of said rotor body, said rotor sleeve extending above the first end surface of said rotor body; and a contact disposed in at least one of the plurality of slots in the second end surface of said rotor body;

a detent spring disposed in said transverse bore; and a pair of detent bullets disposed on opposite ends of said spring and selectively engaged with said recesses.

2. The switch rotor of claim 1 further comprising:

a spring stop disposed in each of said plurality of slots; and a spring disposed between the spring stop and a first surface of said contact.

3. The switch rotor of claim 2 wherein:

each of said plurality of slots are provided from a bottom wall and a pair of sidewalls each of said sidewalls having a shoulder region therein;

said contact is provided as a U-shaped member comprising:

a cross bar having first and second opposing ends, said cross bar having a pair of diametrically opposed raised surfaces; and a pair of legs disposed on opposite ends of said cross bar with each of said legs having at least one surface with a protrusion thereon, each of said protrusions engaging said slot shoulders to limit the motion of said contact relative to said slot in at least one direction; and said spring is in contact with said spring stop and disposed about a first one of said raised surface of said base region.

4. A keylock switch rotor comprising:

a lock assembly;

a switch case having a bore therethrough coupled to a first end of said lock assembly;

a collar disposed between said lock assembly and said switch case, said collar having a plurality of mechanical stops provided thereon to provide said lock assembly with a first mechanical travel;

said switch case, coupled to said lock assembly, having first and second opposing ends and having an inner sidewall surface which defines a cavity region, said inner sidewall surface having provided therein a plurality of recess regions;

a platform having a sleeve portion with a bore therethrough disposed in the cavity regions of said switch case and coupled to the inner sidewall;

a rotor disposed in the cavity region of said switch case, said rotor comprising:

a rotor body having first and second opposing end surfaces, a recess provided in a central portion of the first end surface of said rotor body, a plurality of slots provided in the second end surface of said rotor body, and a transverse bore provided through opposing side surfaces of said rotor body;

a rotor sleeve disposed in the central recessed portion of said rotor body, said rotor sleeve extending above the first end surface of said rotor body and engagingly coupled to said lock assembly; and a contact disposed in at least one of the plurality of slots in the second end surface of said rotor body;

a detent spring disposed in said transverse bore; and a pair of detent bullets disposed on opposite ends of said spring.

5. The switch rotor of claim 4 further comprising:

a spring stop disposed in each of said plurality of slots; and a spring disposed between the spring stop and a first surface of said contact.

6. The switch rotor of claim 5 wherein:

each of said plurality of slots are provided from a bottom wall and a pair of sidewalls each of said sidewalls having a shoulder region therein;

said contact is provided as a U-shaped member comprising:

a cross bar having first and second opposing ends, said cross bar having a pair of diametrically opposed raised surfaces; and a pair of legs disposed on opposite ends of said cross bar with each of said legs having at least one surface with a protrusion thereon, each of said protrusions engaging said slot shoulders to limit the motion of said contact relative to said slot in at least one direction; and said spring is in contact with said spring stop and disposed about a first one of said raised surface of said base region.

7. A mechanically programmable keylock switch rotor comprising:

a lock assembly;

a switch case having a bore therethrough coupled to a first end of said lock assembly;

a collar disposed between said lock assembly and said switch case, said collar having a plurality of mechanical stops provided thereon wherein said collar may be disposed in said lock assembly in one of a plurality of orientations wherein in response to a particular orientation of said collar in said lock assembly, said lock assembly is progvided having a corresponding mechanical travel;

said switch case, coupled to said lock assembly, having first and second opposing ends and having an inner sidewall surface which defines a cavity region, said inner sidewall surface having provided therein a plurality of recess regions;

a platform having a sleeve portion with a bore therethrough disposed in the cavity region of said switch case and coupled to the inner sidewall surface;

a rotor, having a transverse bore therethrough, said rotor disposed in the cavity region of said switch case; and a detent mechanism disposed between said rotor and said switch case.

8. The switch rotor of claim 7 further comprising:

a spring stop disposed in each of said plurality of slots; and a spring disposed between the spring stop and a first surface of said contact.

9. The switch rotor of claim 8 wherein:

said detent mechanism comprises:

a spring disposed in the transverse bore of said rotor; and a pair of detent bullets disposed on opposite ends of said spring, said rotor comprises:

a rotor body having first and second opposing end surfaces, a recess provided in a central portion of the first end surface of said rotor body, a plurality of slots provided in the second end surface of said rotor body, and wherein the transverse bore is provided through opposing side surfaces of said rotor body;

a rotor sleeve disposed in the central recessed portion of said rotor body, said rotor sleeve extending above the first end surface of said rotor body and engagingly coupled to said keylock; and a contact disposed in at least one of the plurality of slots in the second end surface of said rotor body.

10. A switch rotor comprising:

a lock body having first and second opposing ends wherein the first end of said lock body is adapted to receive a turning mechanism;

a sleeve projecting from the second end of the lock body, said sleeve rotatable in response to said turning mechanism; and a collar disposed on the second end of said lock body, said collar having a plurality of mechanical stops provided thereon wherein said collar may be disposed in said lock body in one of a plurality of orientations wherein in response to a particular orientation of said collar in said lock body, said turning mechanism is provided having a corresponding mechanical travel.

11. The switch rotor of claim 10 further comprising a torsion spring, wherein a first end of said torsion spring is coupled to a first one of said sleeve and said collar and a second end of said torsion spring is coupled to said collar.

12. The switch rotor of claim 11 further comprising:

a switch case having a bore therethrough coupled to the second end of said lock body;

a switch case, coupled to said lock body, having first and second opposing ends and having an inner sidewall surface which defines a cavity region, said inner sidewall surface having provided therein a plurality of recess regions;

a platform having a sleeve portion with a bore therethrough disposed in the cavity region of said switch case and coupled to the inner surface of said switch case wall;

a rotor, having a transverse bore therethrough, said rotor disposed in the cavity region of said switch case; and a detent mechanism disposed between said rotor and said switch case.

13. A switch rotor comprising:

a rotor, having first and second opposing surfaces and having substantially continuous sidewalls of a predetermined thickness, wherein said sidewalls are provided having a slot therein, said slot extending between the first and second surfaces of said rotor and opposing sidewalls of said slot having a shoulder region provided therein;

a boss disposed in the slot;

a substantially U-shaped contact disposed in the slot, said contact comprising:

a cross bar having a first end and a second end and having first and second opposing surfaces, wherein a the first surface is provided having a raised portion;

a pair of contact legs, each of said legs having a first bulbed end and each of said legs having a second end terminating in first and second opposing ends of the cross bar wherein the bulbed end of each of said legs are disposed to contact the corresponding shoulder regions of said slot;

a spring disposed between the raised portion of the cross bar and the boss disposed in the slot of the rotor, wherein the spring urges the bulbed portions of the contact legs against corresponding ones of the shoulder region provided in the slot.

14. The switch rotor of claim 13 wherein the rotor is provided having a transverse bore therethrough and a detent mechanism is disposed in the transverse bore of said rotor.

15. The switch rotor of claim 14 wherein the second surface of the contact cross bar is provided having a raised portion having a semicircular shape.

16. The switch rotor of claim 15 wherein the contact is provided having a plating material disposed over the surface thereof and wherein the plating material is provided from a first one of the group comprising silver and gold.

17. The switch rotary of claim 16 wherein the rotor further includes a rotor shaft disposed along the central longitudinal axis of a centrally located recess provided in the rotor, wherein the rotor shaft extends past the second surface of said rotor and wherein said rotor shaft is provided having a first raised portion and a second portion.

* * * * *

UNITED STATES PATENT AND TRADEMARK OFFICE

CERTIFICATE OF CORRECTION

PATENT NO. : 5,408,062

DATED : April 18, 1995

INVENTOR(S) : William J. Agnatovech

It is certified that error appears in the above-indentified patent and that said Letters Patent is hereby corrected as shown below:

Column 5, line 33, "a key lock 60 includes" should read --a keylock body 60 includes--.

Column 5, line 41, "The bottom portion includes" should read --The bottom portion 62 includes--.

Column 8, line 9, "cavity regions" should read --cavity region--.

Column 8, line 10, "inner sidewall;" should read --inner sidewall surface of said switch case;--.

Column 8, line 64, "progvided" should read --provided--.

Column 9, line 5-6, "sidewall surface;" should read --sidewall surface of said switch case;--.

Signed and Sealed this

Seventeenth Day of October, 1995

*Attest:*

Bruce Lehman

BRUCE LEHMAN

*Attesting Officer*

*Commissioner of Patents and Trademarks*